US007913875B2

(12) United States Patent
Goddard et al.

(10) Patent No.: US 7,913,875 B2
(45) Date of Patent: Mar. 29, 2011

(54) DISPENSER FOR FOLDERS

(75) Inventors: George Hill Goddard, Chino Hills, CA (US); Meryl Altuch, Port Washington, NY (US)

(73) Assignee: Esselte Leitz GmbH & Co. KG, Stuttgart (DE)

( * ) Notice: Subject to any disclaimer, the term of this patent is extended or adjusted under 35 U.S.C. 154(b) by 1113 days.

(21) Appl. No.: 11/107,850

(22) Filed: Apr. 18, 2005

(65) Prior Publication Data

US 2006/0231564 A1 Oct. 19, 2006

(51) Int. Cl.
*B65H 1/00* (2006.01)

(52) U.S. Cl. ..... 221/63; 221/33; 221/45; 221/46; 221/303; 221/305

(58) Field of Classification Search ..... 221/33, 221/45, 46, 47, 48, 61, 62, 63, 303, 305, 221/306, 36, 64, 49, 51, 281, 26, 37; 493/90; 220/6, 3.92, 3.94, 7, 62, 62.1
See application file for complete search history.

(56) References Cited

U.S. PATENT DOCUMENTS

| | | | | |
|---|---|---|---|---|
| 2,797,041 | A | 6/1957 | Rondone | 229/39 |
| 2,799,393 | A | 7/1957 | Klein | 206/58 |
| 3,024,958 | A * | 3/1962 | Loderhose | 229/242 |
| 3,254,793 | A * | 6/1966 | Palmer | 221/63 |
| 3,583,597 | A | 6/1971 | Buttery et al. | 221/33 |
| 3,826,361 | A * | 7/1974 | Heckrodt | 206/409 |
| 4,265,366 | A | 5/1981 | Schillinger et al. | 221/33 |
| 4,413,769 | A * | 11/1983 | Michetti | 229/120.17 |
| 4,459,127 | A * | 7/1984 | Kunzel | 493/69 |
| 4,512,476 | A * | 4/1985 | Herrington, Jr. | 206/554 |
| 5,219,421 | A * | 6/1993 | Tipping | 221/63 |
| 5,476,219 | A * | 12/1995 | Kim | 229/132 |
| 5,678,728 | A * | 10/1997 | Leto | 221/185 |
| 6,142,365 | A * | 11/2000 | Breitbach | 229/198.2 |
| 7,028,834 | B2 * | 4/2006 | Karpel | 206/5 |
| 2002/0056526 | A1 * | 5/2002 | Kelders et al. | 156/577 |
| 2003/0234252 | A1 * | 12/2003 | Howard | 220/62.1 |

FOREIGN PATENT DOCUMENTS

WO WO 2005035264 A2 * 4/2005

* cited by examiner

*Primary Examiner* — Gene Crawford
*Assistant Examiner* — Michael K Collins
(74) *Attorney, Agent, or Firm* — Morgan Lewis & Bockius LLP

(57) ABSTRACT

A dispensing apparatus for dispensing flexible folders, the dispensing apparatus comprising a body for housing a roll of a plurality of folders, the body comprising a holding member extending into an interior space defined by the body and arranged for holding the plurality of folders in a roll arrangement.

4 Claims, 9 Drawing Sheets

DISPENSER FOR FOLDERS

FIELD OF INVENTION

The present invention relates to a dispenser for folders.

BACKGROUND TO THE INVENTION

Folders or pockets made of a plastic material or the like are known. For example, these plastic folders are made of a relatively flexible material and the user can put papers in a document pocket of the folder. The plastic folders containing papers can then be placed in a ring binder. Plastic folders are a simple and safe way of storing paper documents such that they are well protected from moisture and dirt by being inserted into the document pocket.

Typically, a supply of folders is provided to a customer in a stack contained in a cardboard box or bag. The size of the cardboard box reflects the size of the folder. For example, for A4 sized folders, an A4 size box is provided. However, these boxes take up a considerable amount of room, thus causing inconvenience to the user. Additionally, removing folders out of the box requires a user either to remove a lid or to put his hand in one end of the box. This is not particularly convenient

SUMMARY OF INVENTION

It is an aim of the embodiments of the present invention to address the aforementioned problems.

According to a first aspect of the present invention there is provided a dispensing apparatus for dispensing flexible folders, the dispensing apparatus comprising a body for housing a roll of a plurality of folders, the body comprising a holding member extending into an interior space defined by the body and arranged for holding the plurality of folders in a roll arrangement.

By providing a holding member which extends into the interior of the dispensing apparatus, the plurality of flexible folders may be held in a roll configuration. The holding member prevents the roll from unravelling within the body of the dispensing apparatus. According to an embodiment of the invention the folders do not need to be rolled onto a cylindrical core to form a roll arrangement for insertion into the dispensing apparatus. As no cylindrical core is required, the arrangement is cheaper to manufacture. Folders are inserted directly into the assembled dispensing apparatus in a loose roll without the need for a further element in the form of a cylindrical core.

Preferably, the dispensing apparatus comprises an exit for dispensing folders therethrough, the holding member being arranged so as to both hold the plurality of folders in a roll arrangement and also simultaneously act as a guide for aiding the removal of the folders through the exit.

Such an arrangement is advantageous as the utilisation of a single member for both holding the supply of folders in a roll and guiding the folders for easy removal through the opening negates the requirement for separate members for holding the supply roll and guiding folders. Manufacturing costs are therefore reduced by decreasing material costs and the complexity of the dispensing apparatus. This arrangement provides a highly efficient use of materials.

Preferably, the holding member is positioned adjacent to said exit for guiding the folders through the exit. Preferably, the holding member comprises a surface projecting inside the holder adjacent to the exit for holding an end of the roll of folders adjacent the exit. This arrangement aids a user in griping and pulling the folders through the exit.

Preferably, the exit is defined by at least one tear-line defining a lid which is movable between a closed position and an open position for removing folders through the opening.

This arrangement is advantageous as the dispensing apparatus can be transported, sold and stored with the lid in a closed configuration so as to protect the folders held therein from dirt and moisture while also preventing accidental dispensing of the folders through the opening.

Preferably, the lid has a hole or a flap for a user to grip for breaking the tear-line and moving the lid from a closed to an open configuration. Such an arrangement allows for easier use.

Preferably, the tear-line is adapted whereby the lid may be held in its closed configuration after breaking of the tear-line. One such arrangement comprises a plurality of teeth which hold the lid in the closed configuration even after breaking of the tear-line.

Preferably, the body of the dispensing apparatus is in the form of a cylinder having a substantially square, a substantially rectangular, or a substantially circular cross-section.

Preferably, the dispensing apparatus has a length substantially equal to a width of a standard folder. This may be A4 or A3 size for example.

Preferably, the body of the dispensing apparatus has at least one end comprising a projection arranged to support an end of the roll of folders. Preferably, the at least one end comprises an inward projection arranged to be received in the roll of folders. Preferably two opposed ends of the body have an inward projection arranged for being received in the roll of folders. Preferably each end comprises two foldable end portions, each foldable end portion having an inward projection arranged for being received in the roll of folders.

Preferably, the holding member comprises foldable end flaps for holding the holding member in a holding configuration, the end flaps and end portions being arranged whereby when the inward projections of the end portions are arranged in the roll of folders, the end portions hold the end flaps thereby holding the holding member in the holding configuration.

Preferably, the dispensing apparatus is constructed from a single piece of material. Embodiments of the invention can be achieved with a single piece of material cut into a suitable blank and assembled. Manufacturing costs are reduced by decreasing material costs and the complexity of the dispensing apparatus. This arrangement provides a highly efficient use of materials.

According to a second aspect of the present invention there is provided a dispensing apparatus containing a supply of a plurality of flexible folders held therein in a roll configuration, the dispensing apparatus comprising a body housing the roll of folders, the body comprising a holding member extending into an interior space defined by the body and arranged to hold the plurality of folders in a roll arrangement.

Preferably, the supply of folders is held in the body of the dispensing apparatus in a loose roll without a core member.

Preferably, one end of the roll is held against an underside of the holding member with the other end of the roll passing over an upper surface of the holding member for guiding the folders through an exit of the dispenser in use.

Preferably, the plurality of flexible folders are in a loose roll configuration substantially in the shape of a number six ("6") having a lower loop and an upper curve with the holding member passing through a gap between the upper curve and the lower loop.

According to a third aspect of the present invention there is provided a blank for constructing a dispensing apparatus for a supply of flexible folders, the blank comprising a first, a second, a third, a fourth, a fifth and a sixth panel, each of the panels being substantially rectangular and connected in sequence via fold lines, the first and second panels have tear lines therein defining a lid of the dispensing apparatus, the first, second, third and sixth panels having foldable flaps on opposing sides thereof for forming ends of the dispensing apparatus, and the fourth panel having two slits therein respectively adjacent opposing sides thereof.

Preferably, the first and third panels are the same size, the second and fourth panels are the same size, and the fifth and sixth panels are smaller than any one of the first, second, third and fourth panels. The foldable flaps on the first and third panels may be substantially the same shape and comprise foldable projections. The foldable flaps on the second panel may have projections for insertion into the slits of the fourth panel.

BRIEF DESCRIPTION OF THE DRAWINGS

For a better understanding of the present invention and to show how the same may be carried into effect, reference will now be made by way of example to the accompanying drawings, in which.

DETAILED DESCRIPTION OF THE EMBODIMENT OF THE INVENTION

Figure 1:
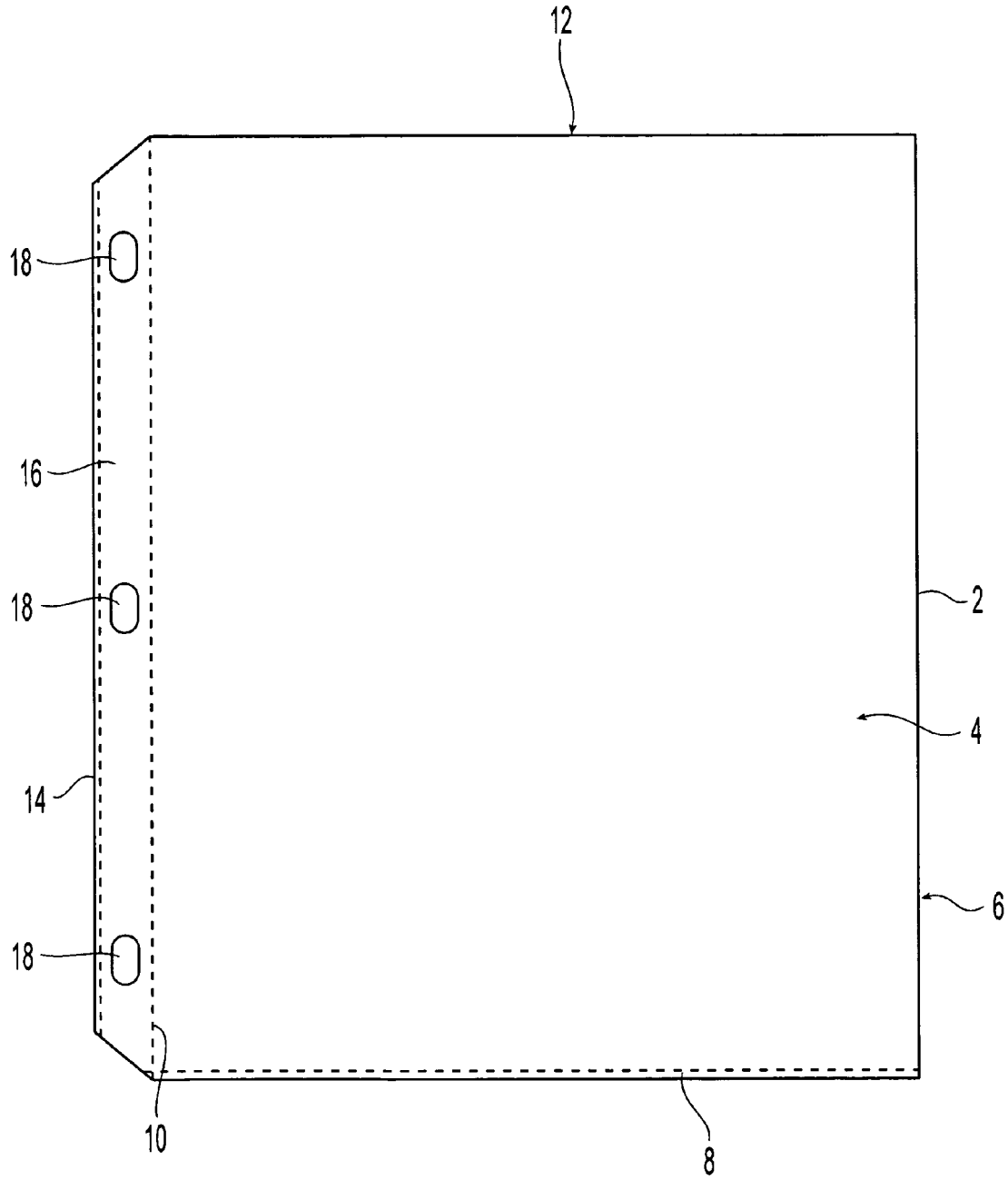
FIG. 1 shows a flexible folder for use with embodiments of the present invention.

FIG. 1 shows a transparent plastic storage folder for use with a dispensing apparatus of the present invention. The folder is produced using a transparent plastic film. The plastic film is folded along a folded edge 2 so as to form a front cover 4 and a rear cover 6 which is connected in one piece thereto by the folded edge 2 and overlaps the front cover 4. Front and rear covers 4, 6 are connected to one another by a first interrupted decorative weld seam 8 along a lower edge of the storage folder running transversely to the folded edge 2. A second weld seam 10 is provided parallel to the folded edge 2 on a side opposed to the folded edge 2. The first and second weld seams 8, 10 and the folded edge 2 form a pocket for insertion of documents through an opening 12 formed in an upper edge.

A third weld seam 14 is provided parallel to the second weld seam 10 and adjacent thereto forming a pocket in which a reinforcing material 16 is provided. Three holes 18 are provided along the edge of the folder through the reinforcing material 16 for mounting the folder in a ring binder in use. The reinforcing material 16 prevents the holes 18 being torn when mounted in the ring binder. The holes 18 may be provided at different positions along the edge of the folder depending on the type of ring binder to which the folder is to be mounted.

Figure 2:
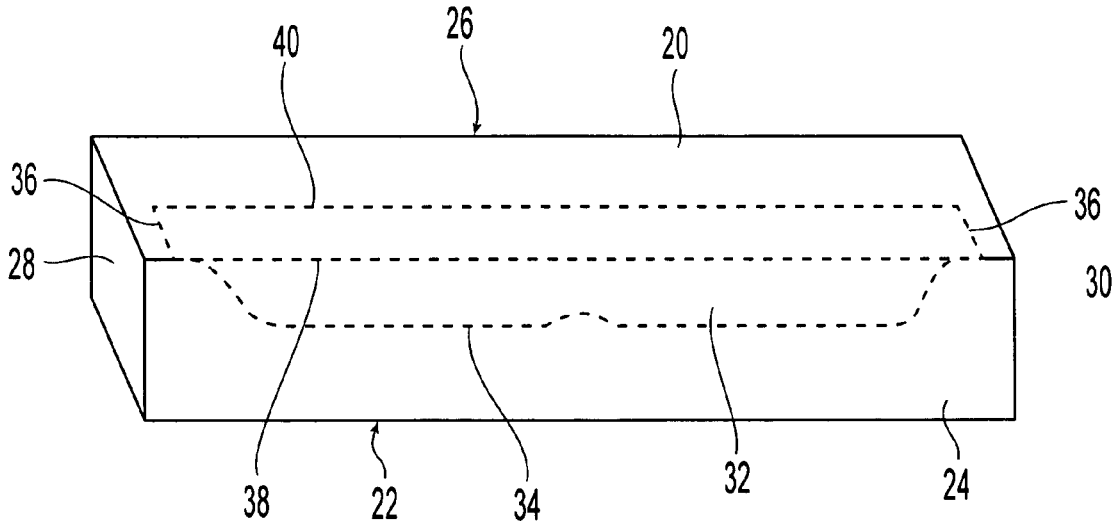
FIG. 2 shows a dispensing apparatus according to an embodiment of the present invention.

FIG. 2 shows a dispensing apparatus according to an embodiment of the present invention. The dispensing apparatus comprises a substantially rectangular box having a top 20, a bottom 22, two opposing sides 24, 26 and two opposing ends 28, 30. The dispensing apparatus has a lid 32 defined by tear-lines 34, 36 and fold lines 38, 40. The lid 32 extends partly across the top 20 of the dispenser and partly across one of the sides 24 of the dispenser. The lid 32 has a thumb sized opening 42 for aiding a user in opening and closing the lid 32.

Figure 3:
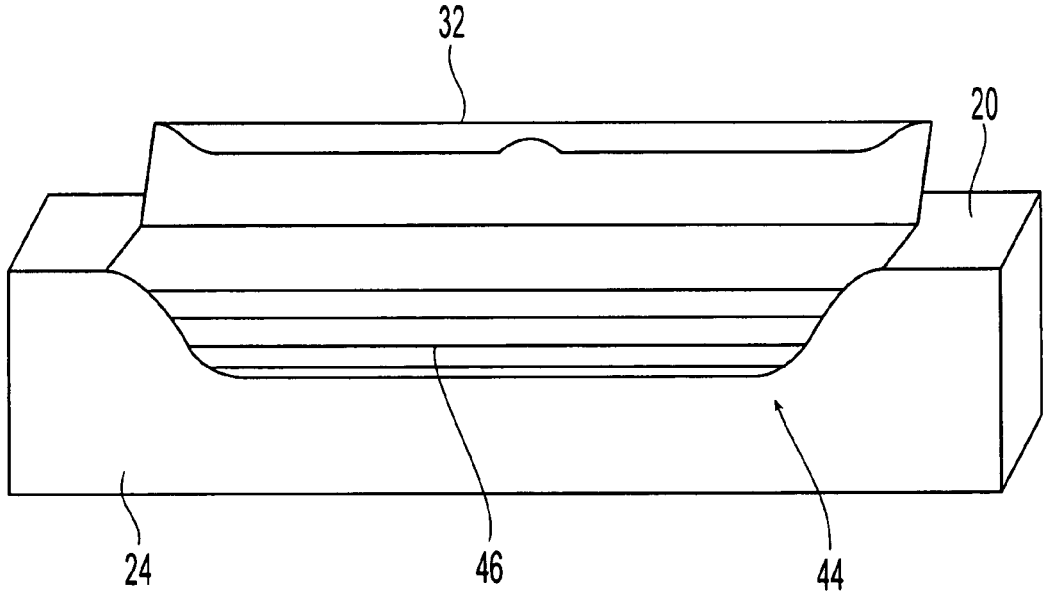
FIG. 3 shows the dispensing apparatus of FIG. 2 with the lid in an open configuration.

FIG. 3 shows the dispensing apparatus with the lid 32 in an open configuration so as to form an exit 44 through which the folders 46 may be dispensed. In moving the lid 32 into this open configuration, tear-lines 34, 36 (shown in FIG. 2) are broken and the lid 32 is folded back along fold lines 38, 40 (shown in FIG. 2) so as to form the exit 44. The exit 44 is formed partially along the side 24 of the dispensing apparatus and partially along the top 20 of the dispensing apparatus to enable a user to easily pull a folder through the exit 44.

Figure 4:
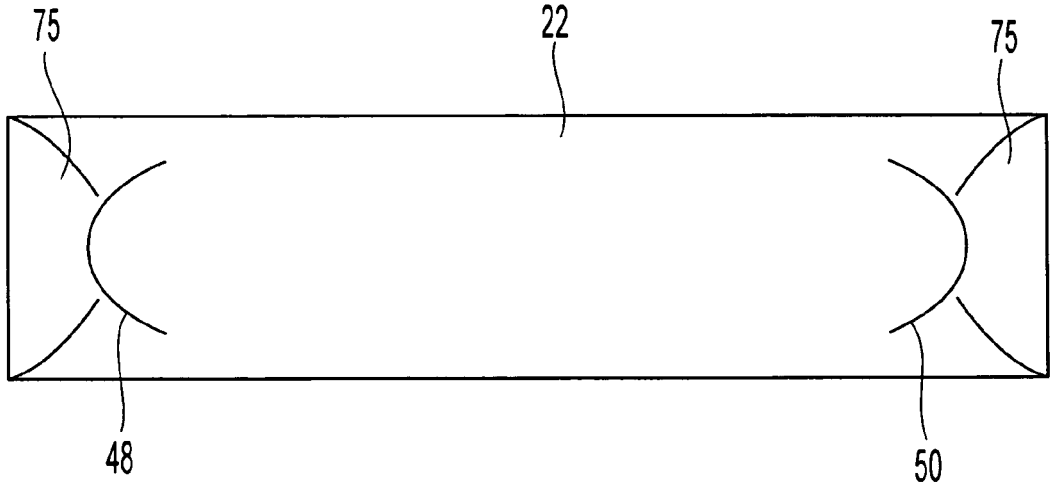
FIG. 4 shows an underside of the dispensing apparatus.

FIG. 4 shows the bottom 22 of the dispensing apparatus having curved cut portions 48, 50 adjacent either end thereof. Flap 52 in either end 28, 30 (shown in FIG. 2) of the dispensing apparatus are folded along the bottom 22 to form attachment member 75. One attachment member 75 is inserted into each of the cuts 48, 50 so as to hold the dispensing apparatus in its configured arrangement.

Figure 5:
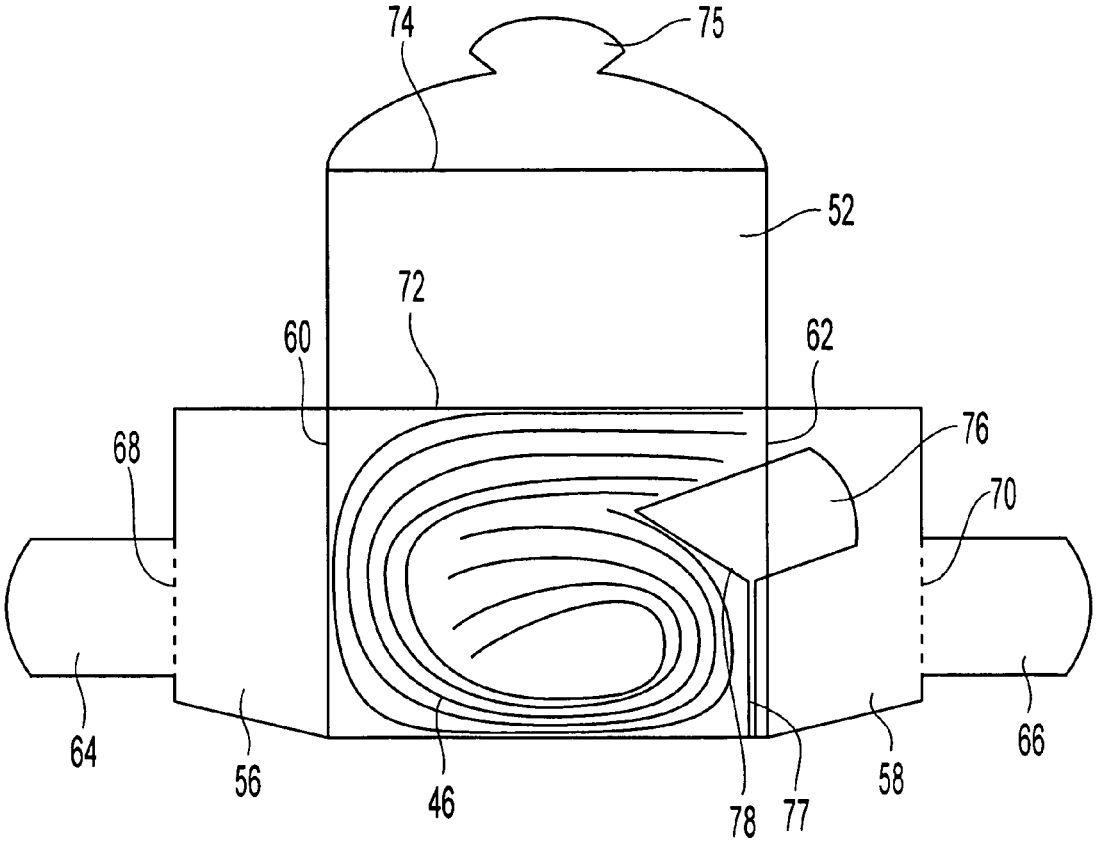
FIG. 5 shows an end of the dispensing apparatus in an open configuration.

FIG. 5 shows the end 28 of the dispensing apparatus in an open configuration. The end 28 has opposing end portions 56, 58 foldable along lines 60, 62. The end portions have projections 64, 66 foldable along lines 68, 70. A top flap 52 is foldable along lines 72, 74. The top flap has an attachment member 75 for cooperating with the cut 48 illustrated in FIG. 4. The plurality of folders 46 are held in the dispensing apparatus in a loose roll substantially in the shape of a number six ("6") by a holding member (shown more clearly in FIG. 8) which extends into the interior of the dispensing apparatus between the upper curve and the lower loop of the loose roll of folders 46. The holding member has an end flap 76 foldable along a line 78. An overlapping portion 77 extends along an interior surface of the front side 24 and is glued to the front side 24 so as to hold the dispenser body in a cylindrical arrangement.

Figure 6:
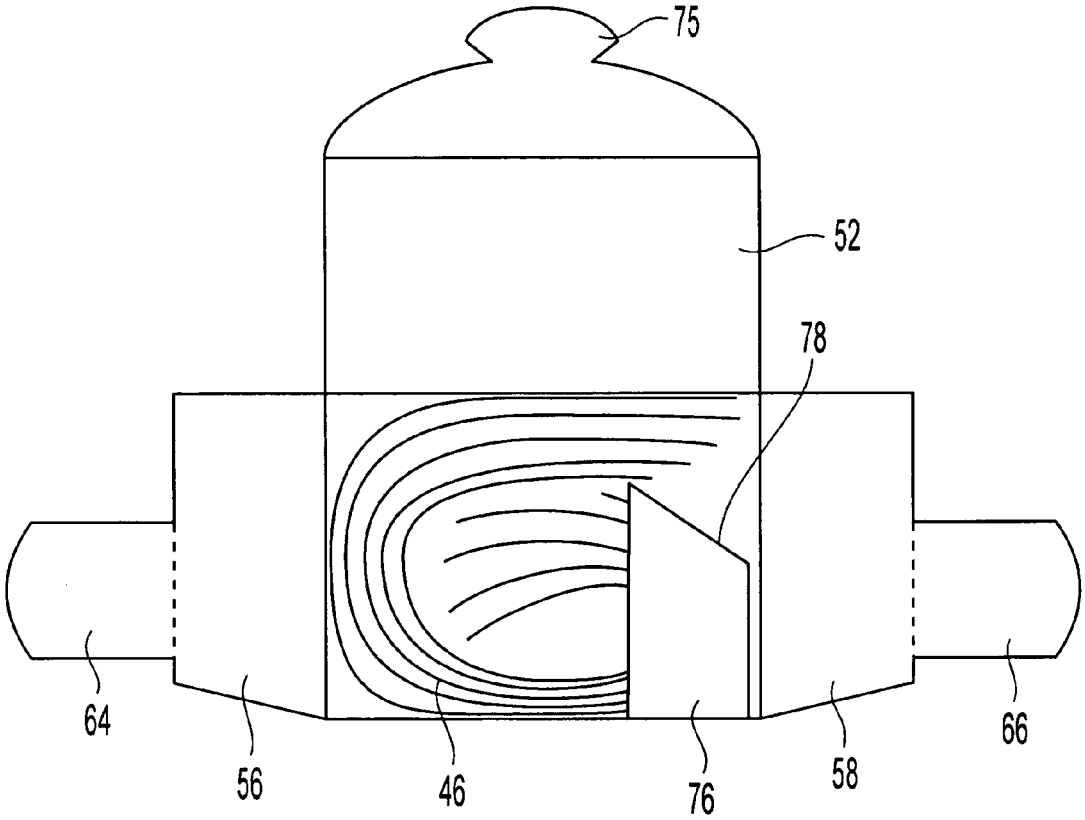
FIG. 6 shows the end of the dispensing apparatus with an end flap of the holding member folded down.

To construct the end 28, the flap 76 of the holding member is first folded downwards along line 78 as shown in FIG. 6. Both end portions 56, 58 are then folded inwards with the projecting portions 64, 66 (not visible) being inserted into the opening of the lower loop of the roll of folders 46 (not visible). The top flap 52 is then folded downwards and the attachment member 75 inserted into the cut 48 in the bottom 22 of the dispensing apparatus as shown in FIG. 4 thereby holding the end 28 of the dispensing apparatus in a closed arrangement.

Figure 8:
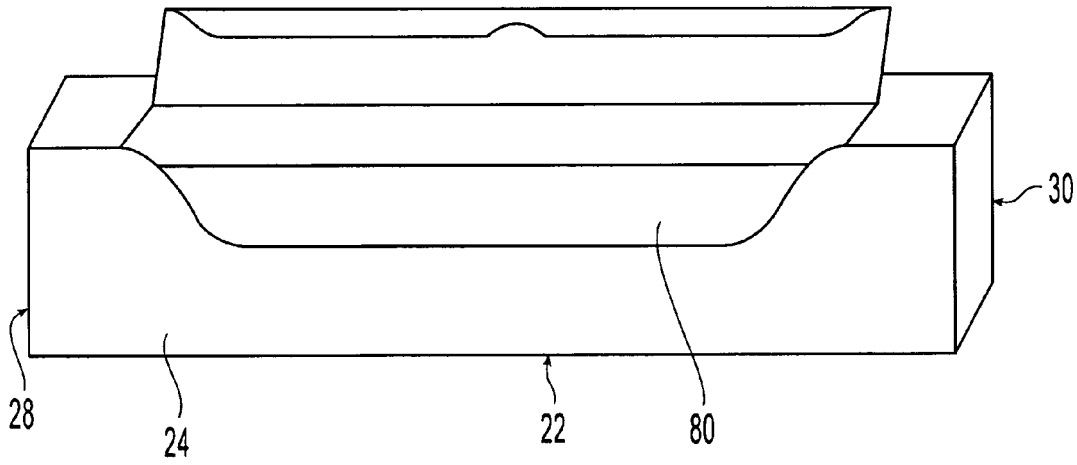
FIG. 8 shows the dispensing apparatus in an open configuration without flexible folders therein.

FIG. 8 shows the dispensing apparatus in an open configuration with no folders provided therein so as to clearly show the holding member 80 which comprises an elongate member having a flat upper and a flat lower surface extending from one end 28 of the dispenser to the other end 30. The holding member 80 extends from the front side 24 into the interior of the dispenser toward the rear side 26 at an angle of 90 to 180° relative to the bottom 22. Preferably the angle is between 40 and 50°. Preferably the holding member extends approximately half way across the interior of the dispenser from the front side 24 to the rear side 26. The lower surface of the holding member 80 abuts the lower loop of the plurality of folders for holding the folders in a loose roll arrangement as shown in FIG. 5. The upper surface of the holding member provides a shelf on which the upper curve of the roll of folders sits. The holding member 80 is arranged such that the upper curve of the roll is held adjacent the exit for easy removal of the folders as shown in FIG. 3.

Figure 7:
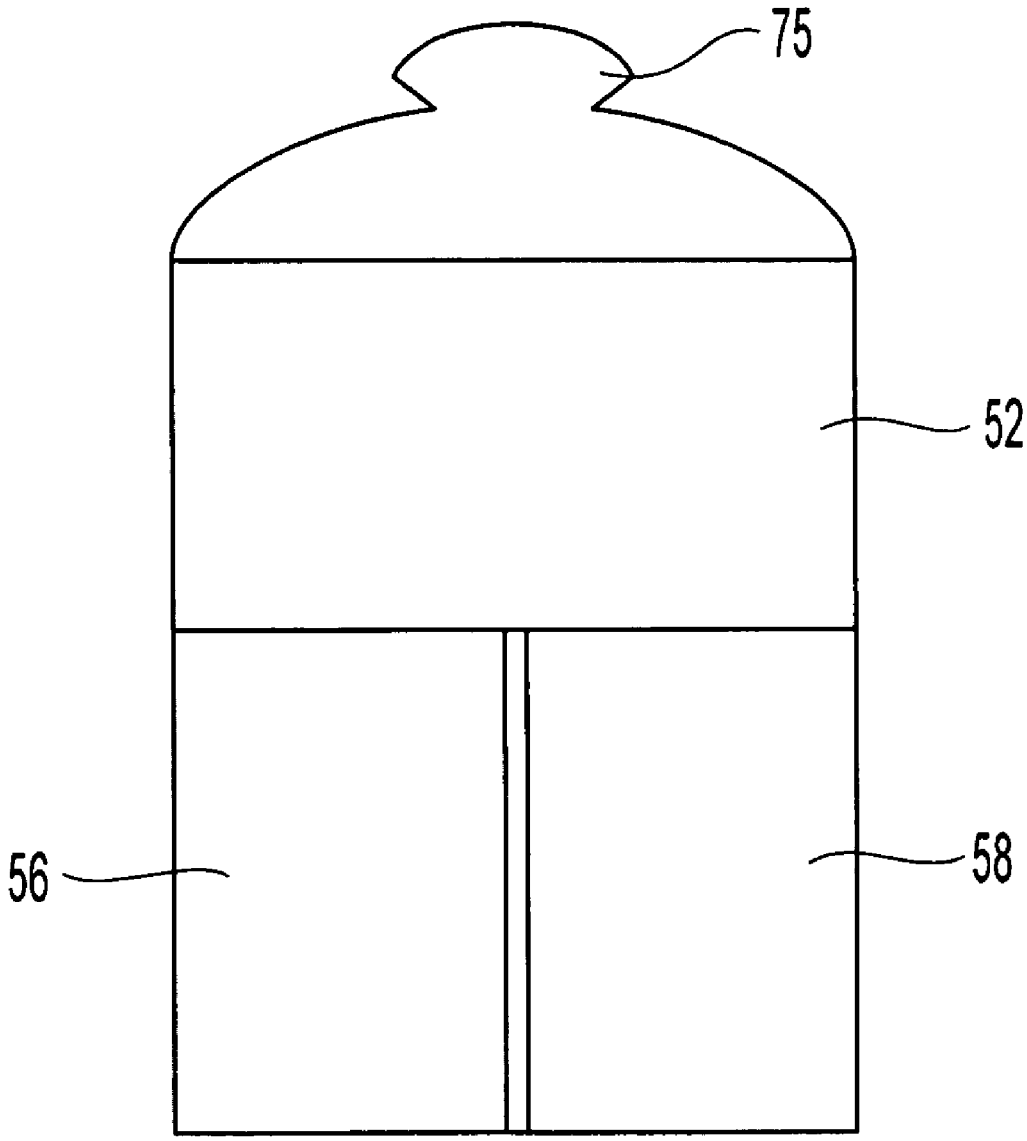
FIG. 7 shows the end of the dispensing apparatus with the two foldable end portions folded such that their inward projections are received in the roll of folders.

FIG. 7 shows a blank of the dispensing apparatus. The blank is made of a single piece of material from which the whole dispensing apparatus is configured. The blank comprises six panels having fold lines therebetween. The panels are labelled so as to correspond to the parts of the dispensing apparatus illustrated in the previous Figures. As such, the top panel forms the front side 24 of the dispenser, the second panel forms the top 24 of the dispenser, the third panel forms the rear side 26 of the dispenser, the fourth panel forms the bottom 22 of the dispenser, the fifth panel forms the overlapping portion 77 of the dispenser and the sixth panel forms the holding member 80 of the dispenser. The lid 32 is defined in the first and second panels 24, 20 by perforated lines 34, 36, 38, 40 (see also FIG. 2). The two curved cuts 48, 50 are provided in the fourth panel 22 adjacent opposite sides thereof (see also FIG. 4). Furthermore, end flaps are provided on the first, second, third and sixth panels for constructing the dispensing apparatus (see also FIGS. 5, 6 and 7).

Figure 9:
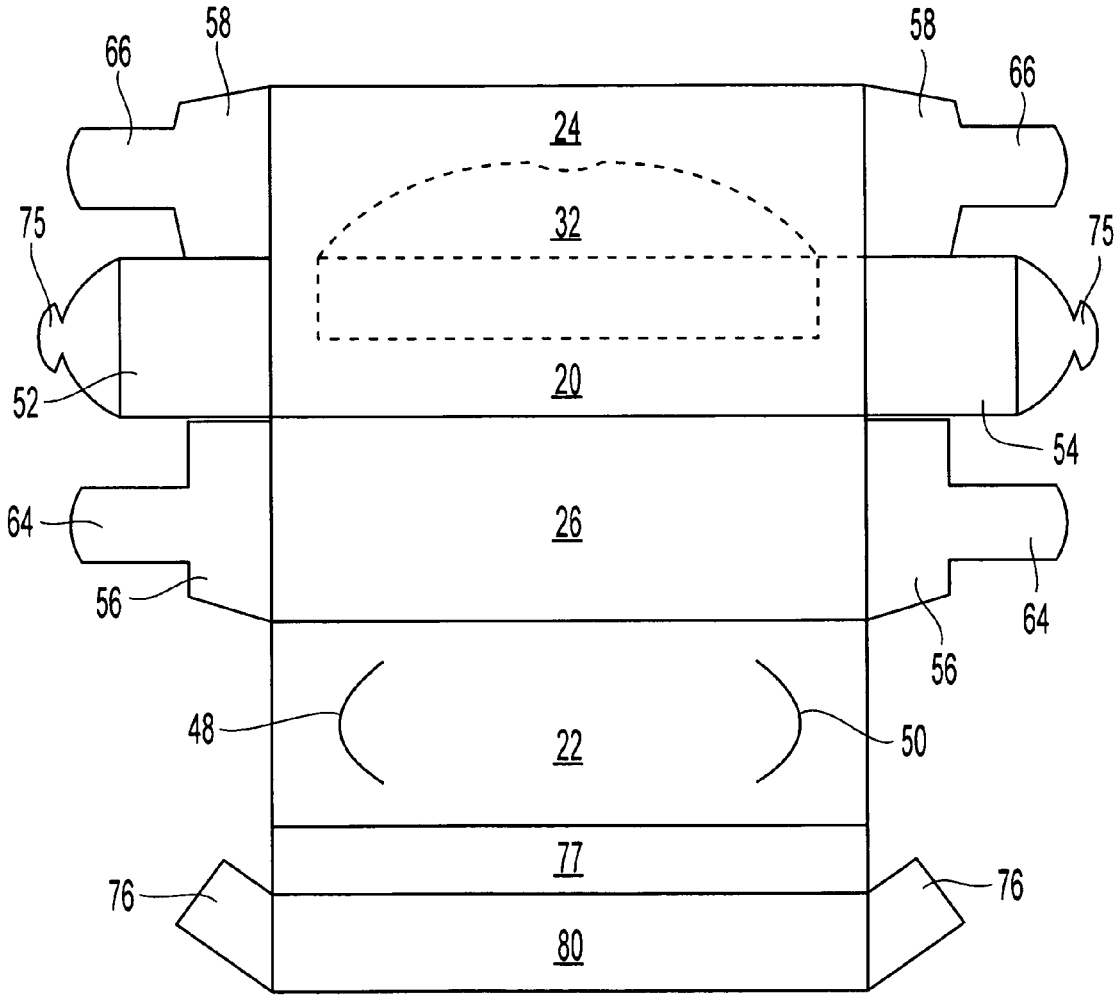
FIG. 9 shows a blank of the dispensing apparatus of FIGS. 2 to 8.

During construction the blank is folded along the fold lines and an outer surface (as viewed in FIG. 9) of the first panel 24 is glued to a back surface (as viewed in FIG. 9) of the fifth panel 77 so as to form a rectangular cylinder with the six panel 80 extending into an interior thereof. In this configuration a loose roll of folders may be inserted into the rectangular cylinder through an end thereof, the folders being arranged substantially in the form of a "6" with the sixth panel 80 passing between the upper curve of the "6" and the lower loop of the "6" as shown in FIG. 5. The ends of the dispensing apparatus are then constructed as previously described with reference to FIGS. 5 to 7.

While this invention has been particularly shown and described with reference to preferred embodiments thereof, it will be understood by those skilled in the art that various changes in the form and details may be made therein without departing from the scope of the invention as defined by the appended claims.

The invention claimed is:

1. A blank for constructing a dispensing apparatus for a supply of flexible folders, the blank comprising a first, a second, a third, a fourth, a fifth and a sixth panel, each of the panels being substantially rectangular and connected in sequence via fold lines, the first and second panels have tear lines therein defining a lid of the dispensing apparatus, the first, second, third and sixth panels having foldable flaps on opposing sides thereof for forming ends of the dispensing apparatus, the fourth panel having two slits therein respectively adjacent opposing sides thereof, and the sixth panel defining a holding element of the dispensing apparatus for holding a plurality of folders in a roll in the shape of the number six.

2. A blank according to claim 1, wherein the first and third panels are the same size, the second and fourth panels are the same size, and the fifth and sixth panels are smaller than any one of the first, second, third and fourth panels.

3. A blank according to claim 1, wherein the foldable flaps on the first and third panels are substantially the same shape and comprise foldable projections.

4. A blank according to claim 1, wherein the foldable flaps on the second panel have projections for insertion into the slits of the fourth panel.

* * * * *